United States Patent [19]

Yokota et al.

[11] 4,205,805

[45] Jun. 3, 1980

[54] AUTOMATIC TAPE WINDUP MEANS

[75] Inventors: Katsuyoshi Yokota, Kamakura; Masao Suzuki; Masaru Tanabe, both of Yokohama, all of Japan

[73] Assignee: NCR Corporation, Dayton, Ohio

[21] Appl. No.: 1,657

[22] Filed: Jan. 3, 1979

[51] Int. Cl.[2] ..... B75H 75/28; B65H 27/00

[52] U.S. Cl. ..... 242/74; 242/76; 242/206

[58] Field of Search ..... 242/67.1 R, 74, 74.1, 242/76, 206, 187

[56] References Cited

U.S. PATENT DOCUMENTS

| | | | |
|---|---|---|---|
| 3,265,318 | 8/1966 | Ellmore | 242/74 |
| 3,301,501 | 1/1967 | Goldberg | 242/74 |
| 3,414,206 | 12/1968 | Ramig | 242/206 |
| 3,450,366 | 6/1969 | Goldberg | 242/74 |
| 3,521,829 | 7/1970 | Wangerin | 242/74 |
| 3,544,040 | 12/1970 | Bundschuh | 242/206 |

*Primary Examiner*—Edward J. McCarthy
*Attorney, Agent, or Firm*—J. T. Cavender; Wilbert Hawk, Jr.; Richard W. Lavin

[57] ABSTRACT

An apparatus is disclosed for automatically starting the winding of a web or strip of paper material onto a rotating take-up spool. Triangular-shaped guide members projecting from opposing sides of the take-up spool guide the free end of the moving web to a position between oppositely-aligned guide members and the hub of the take-up spool allowing the free end of the web to be gripped by other guide members positioned downstream of the engaged guide members for winding the web onto the hub of the take-up spool. The oppositely-aligned guide members have a web supporting surface which is inclined towards the hub and are spaced slightly less than the width of the web allowing the free end of the web to slide to a position beneath the guide members in which the web is gripped by adjacent guide members as the spool rotates resulting in the web being wound onto the spool.

14 Claims, 9 Drawing Figures

AUTOMATIC TAPE WINDUP MEANS

BACKGROUND OF THE INVENTION

The present invention relates to an automatic take-up spool or reel for engaging and retaining the free end of a web or roll of paper or other material, the latter comprising a journal tape on which data is recorded. In present-day data terminal and electronic cash register devices, a journal tape is employed to record thereon the data associated with each transaction carried out by the terminal or the cash register. With the development of integrated circuits and the like, the terminal devices have become more compact and streamlined to the point that the space available for the take-up spool for the journal tape is very limited. This condition has produced lengthy down time of the terminal to install a new roll of tape and to engage the tape with the take-up spool. When this operation occurs during the rush hour in a supermarket, for instance, the delay is a serious limitation to the use of such a terminal in a checkout environment. In order to overcome this problem, cassette-type devices have been developed which contain the paper tape, but the amount of tape that can be incorporated in a cassette is very limited, requiring more frequent interruptions of the terminal operation for changing the cassette together with being more costly.

It is well-known in the web-handling art to provide reel constructions which allow for the automatic engagement of the tape by the reel. Thus, in U.S. Pat. No. 3,414,206, triangular-shaped guide members mounted on one flange of a tape reel coact with a pair of spring-loaded fingers to engage holes in the tape for anchoring the tape to the reel.

In U.S. Pat. Nos. 3,378,212, 3,265,318 and 3,640,483, magnetic tape reels are disclosed which include teeth for engaging the manually-inserted tape between oppositely-located tooth members and one flange of the reel. In U.S. Pat. Nos. 3,395,870, 3,521,829 and 3,837,596, the end of the tape is positioned between the hub and a member having a friction surface for engaging and holding the tape against the hub. While the reel construction of the cited patents perform an automatic take-up operation, their application to the take-up spool in a data terminal device would be very costly, and in most instances would require access to the side of the reel which is not available in the present embodiment.

It is therefore an object of this invention to provide a new and improved low-cost automatic take-up spool. It is a further object to provide a take-up spool which will automatically engage the moving end of a strip of material. It is another object of this invention to provide an automatic take-up spool which accommodates various widths webs or strips of material.

SUMMARY OF THE INVENTION

In order to carry out these objects, there is disclosed a rotating take-up spool which includes a pair of flange members mounted on a hub member. Secured to the inner surface of each of the flange members are a plurality of triangular-shaped projections or guide members equiangularly spaced about the hub member to support opposite edges of a web positioned thereon. The guide members include a supporting edge which is inclined towards the center of the hub allowing the free end of a moving web to slip beneath a first pair of oppositely-aligned guide members to a position between the lower edge of the guide members and the hub member. Guide members positioned downstream of the first pair of guide members support the web on the inclined edge of the guide members and coact with the first pair of guide members to grip the free end of the web to wrap around the hub allowing the spool to take up the web. One flange member is movably mounted on the hub member which allows for different width webs to be used with the spool.

The foregoing and other features and advantages of the invention will be apparent from the following detailed description of the preferred embodiment of the invention together with the accompanying drawings.

DESCRIPTION OF THE PREFERRED EMBODIMENT

Figure 1:
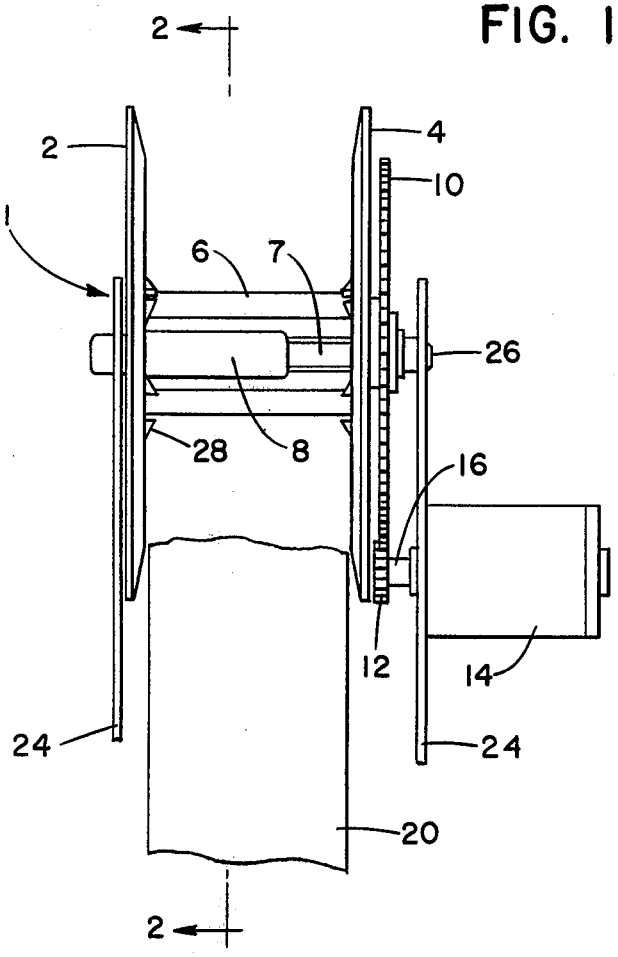
FIG. 1 is an end view of the automatic take-up spool mechanism employing the present invention showing details of the spool mechanism together with the spool drive system.

Referring now to the drawings, wherein like reference numerals designated like parts to the several views, there is shown in FIG. 1 an end view of the take-up spool assembly generally indicated by the reference numeral 1 which comprises a pair of flange members 2 and 4, a hub portion 6 slidably supporting a pair of oppositely-located arm portions 8 (FIGS. 1 and 2) secured to the flange member 2 with each arm portion 8 slidably positioned within a slot 7 extending lengthwise on opposite sides of the hub portion 6. The flange member 4 and the hub portion 6 are secured in any well-known manner to a main supporting shaft 26. As understood from FIG. 2, the shaft 26 is removably mounted in a pair of slotted bearings 23, each secured to the upper portion of one of a pair of spaced frame members 24 located within a terminal device 30.

Secured to one end of the shaft 26 is a gear 10 (FIG. 1) engaged and driven by a drive gear 12 secured to one end of the drive shaft 16 of a motor 14. The flange member 2 is slidably removed from one end of the hub portion 6 in order to remove the wrapped-up roll of web material 20 such as journal tape from the spool assembly 1. After removing the roll of web material 20 from the hub portion 6 of the assembly 1, the flange member 2 is replaced by slidably positioning the arm portions 8 of the flange member 2 within the slots 7 (FIG. 2) of the hub portion 6. It will be appreciated that various widths of web material 20 can be accommodated by the hub portion 6 by slidably positioning the flange member 2 on the hub portion 6 in accordance with the width of the web to be wound thereon. Energizing of the motor 14 will rotate the spool assembly 1 through the action of the gears 10 and 12 in a clockwise direction as viewed in FIG. 2.

Figure 2:
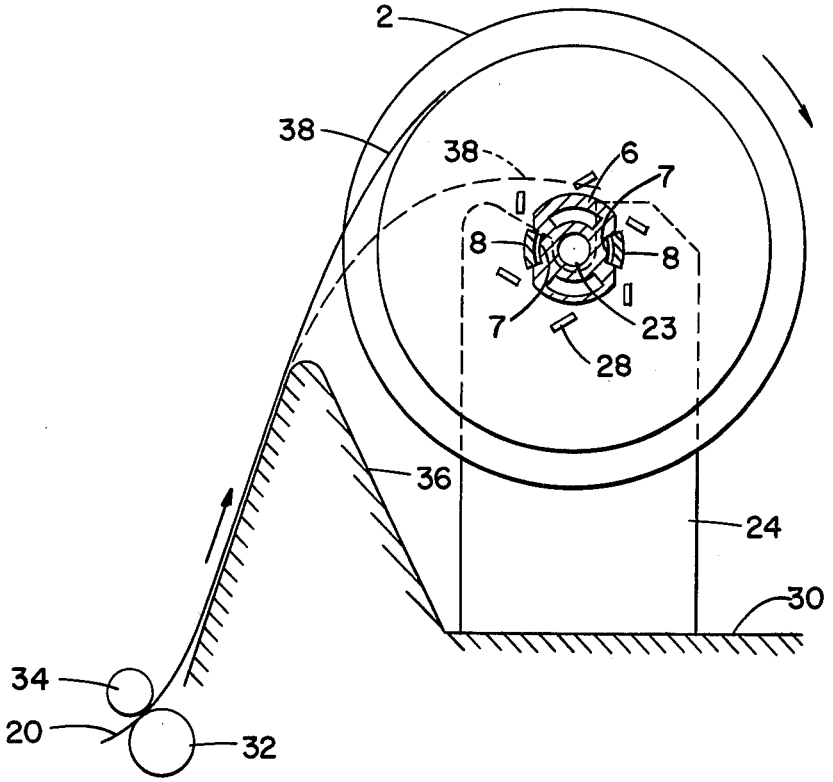
FIG. 2 is a sectional view taken on lines 2—2 of FIG. 1 showing the feed path of the web.

As further shown in FIG. 2, associated with the spool assembly 1 is a web guide 36 which may take any configuration depending on the structure of the terminal in which the take-up spool assembly 1 is located. A drive or feed roller 32 mounted adjacent the web guide 36 coacts with a pressure roller 34 in a manner that is well-known in the art to drive the web 20 along the web guide 36, thereby positioning the free end 38 of the web 20 adjacent the hub portion 6 of the spool assembly 1.

Figure 7:
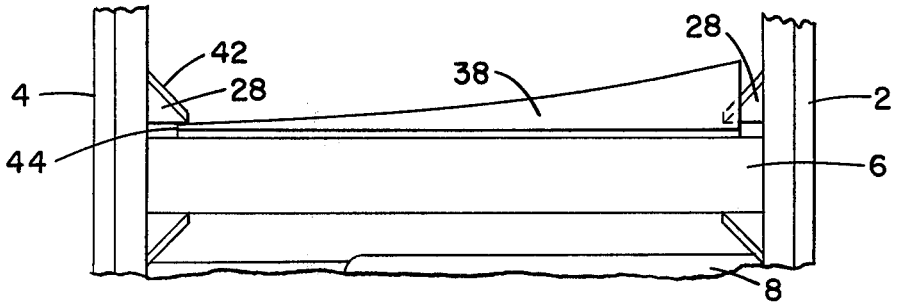
FIG. 7 is an enlarged partial view of the initial engagement of the web by the guide members as shown in FIG. 4.

Mounted on the inside faces of the flanges 2 and 4 (FIGS. 1 and 2) are a plurality of oppositely-aligned triangular-shaped projections or guide members 28 each of whose longitudinal axis is oriented in a direction substantially parallel to the edge of the hub portion 6 (FIG. 2). As shown in FIG. 7, the inwardly-facing angular surface or edge portion 42 of each of the guide members 28 is inclined away from the flange members 2 and 4 and towards the center of the hub portion 6 in a direction opposite to the rotational movement of the spool assembly 1. Each pair of oppositely-aligned guide members 28 extends inwardly from the flange members 2 and 4 to provide an opening between the innermost edges of the guide members 28 whose width is slightly less than the width of the web 20 which is to be taken up by the spool assembly 1. This construction allows the web 20 to be supported by the edge portion 42 of each of the guide members 28.

Figure 3A:
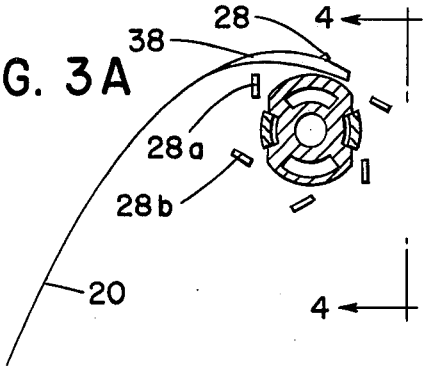
FIGS. 3A–3C inclusive are side sectional views of the hub member together with the guide members showing various stages of the engagement of the web by the guide members and the hub members in wrapping the web onto the hub member.
Figure 3B:
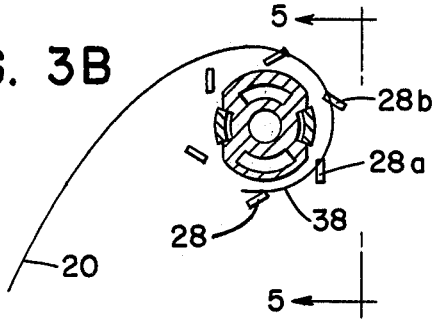
Figure 3C:
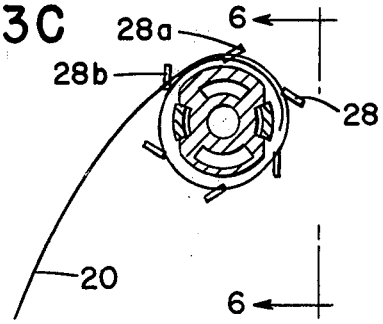

Referring now to FIGS. 3A–C inclusive and 4–7 inclusive, there is shown in sequential stages the operation of the present invention. After mounting a roll of journal tape or other type of web material 20 within the terminal apparatus 30, the operator will insert the free end 38 of the web 20 in an opening (not shown) in the terminal apparatus which locates the free end 38 of the web 20 between the feed roller 32 (FIG. 2) and the pressure roller 34. Upon the depression of a feed key (not shown) located in the keyboard of the terminal device by the operator, the rollers 32 and 34 will grip the free end 38 of the web 20 and feed the web along the web guide 36 (FIG. 2) to a position above the hub member 6 where, due to the weight of the web, the web will move downward into engagement with the inclined edge portions 42 of the guide members 28.

Figure 4:
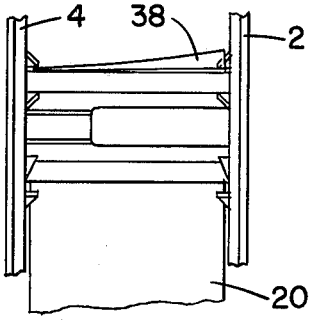
FIG. 4 is a view taken on line 4—4 of FIG. 3A showing the initial movement of the web as it is engaged by a pair of oppositely-aligned guide members.
Figure 5:
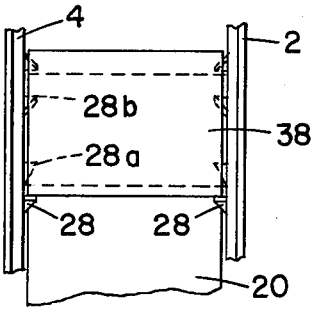
FIG. 5 is a view taken on lines 5—5 of FIG. 3B showing the engagement of the web by adjacent pairs of guide members in which the web is gripped by the guide members to initiate the wrapping of the web on the spool.

Simultaneous with the operation of the rollers 32 and 34 (FIG. 2), actuation of the feed key (not shown) results in the energizing of the motor 14 (FIG. 1) and in the clockwise rotation of the spool assembly 1 through the drive action of the gears 10 and 12 (FIG. 1). The motor 14 rotates the spool assembly 1 (FIG. 1) at a speed which is slightly greater than the forward movement of the web 20 produced by the operation of the rollers 32 and 34. As the free end 38 of the web 20 moves downward into engagement with the inclined edge portions 42 (FIG. 7) of a pair of oppositely-aligned guide members 28, a side edge 44 (FIG. 7) of the web 20 will slip along the inclined edge 42 of one of the guide members 28 to a position beneath the guide member (FIGS. 3A and 4) to be followed by the opposite side edge (FIGS. 3B and 5) of the web 20 thereby locating the free end 38 of the web 20 beneath the oppositely-aligned guide members 28 and adjacent the hub portion 6.

Figure 6:
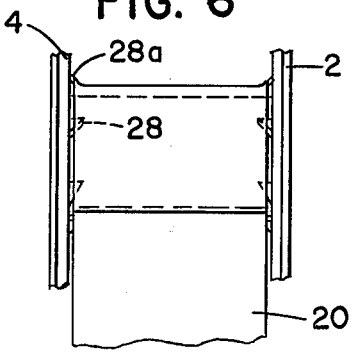
FIG. 6 is a view taken on lines 6—6 of FIG. 3C showing the position of the web on the guide members as the web is taken up by the spool.

Further rotational movement of the spool assembly 1 by the motor 14 results in a portion of the web 20 engaging the inclined edge portions 42 of the following pairs of oppositely-aligned guide members 28*a* and 28*b* (FIGS. 3B and 5) located downstream of the earlier oppositely-aligned guide members 28. As the spool assembly 1 rotates, the free end 38 of the web 20 is gripped by the guide members 28, 28*a* and 28*b* by means of the frictional force existing between the guide members and the web to grip and hold the web free end portion, thereby winding the web 20 around the spool assembly 1 upon subsequent rotation of the feed and pressure rollers 32 and 34 (FIG. 2) and the spool assembly 1. As shown in FIGS. 3C and 6, the web 20 is wound on the inclined edges 42 of the guide members 28, which position facilitates the easy removal of the web from the hub portion 6 in the manner described previously, i.e. sliding the flange member 2 therefrom.

Depending on the weight of the web material 20 used with the spool assembly 1, the movement of the free end 38 of the web 20 to a position beneath the guide members 28 could occur with both side edges 44 of the web 20 moving simultaneously between its associated guide members 28 upon the flexing of the free end 38 of the web 20 into a concave configuration.

While there has been described a form of the invention and its mode of operation, it will be apparent to those skilled in the art that changes may be made in the apparatus described without departing from the spirit and scope of the invention as set forth in the appended claims and that in some cases, certain features of the invention may be used to advantage or modified without corresponding changes in other features, which certain features may be substituted for or eliminated as appreciated by those skilled in the art. It is obvious that the present invention would function in other web take-up applications such as may be found in magnetic tape recorders or photographic projectors. Therefore, it is to be understood that the instant invention shall not be limited beyond the restrictions of the appended claims.

What is claimed is:

1. An automatic take-up device comprising:
   a. a rotatable take-up spool having a hub portion;
   b. a plurality of spaced-apart projections mounted on the spool, each having a web-supporting surface inclined toward said hub portion and a web-engaging surface adjacent said supporting surface;
   c. and means for driving a web into engagement with the web-supporting surfaces of said projections whereby the web moves along said inclined surfaces to a position to be engaged by said engaging surfaces of the projections to initiate the winding of the web onto the take-up spool.

2. The take-up device of claim 1 wherein the projections are triangular in shape and have said web-engaging surfaces extending rearwardly in a plane substantially parallel to the hub portion of the take-up spool.

3. The take-up device of claim 1 wherein the take-up spool includes a pair of spaced-apart supporting surfaces, each surface having mounted thereon said oppositely-aligned projections for supporting the web therebetween on said web-supporting surfaces during the winding of the web on the take-up spool.

4. The take-up device of claim 1 wherein said plurality of projections includes a first pair of projections whose web-engaging surfaces engage the web and a second pair of projections disposed downstream of said first pair of projections whose inclined supporting surfaces support said web and coact with the web-engaging surfaces of said first pair of projections to wind the web onto the web-supporting surfaces of said plurality of projections.

5. The take-up device of claim 1 which further includes means for rotating said take-up spool at a speed greater than the driving speed of the web by said driving means enabling said spool to wind up the web on the spool.

6. A self-threading take-up device comprising:

a rotating take-up reel having a hub portion and a pair of spaced-apart flange surfaces;

a plurality of projections mounted on said flange surfaces away from said hub portion, each of said projections having an inwardly-facing surface inclined towards the hub portion for supporting a web thereon and a web-engaging surface located adjacent said inclined surface and parallel with the surface of said hub portion;

and means for driving a web into engagement with the inclined surfaces of said projections whereby the leading portion of the web will move along said inclined surfaces to a position adjacent said hub portion engaging said engaging surfaces to initiate the winding of the web onto the take-up reel.

7. The take-up device of claim 6 wherein the projections are oppositely aligned on said flange surfaces and extend in a plane substantially parallel to the hub portion in a direction opposite to the rotational movement of the take-up reel.

8. The take-up device of claim 6 which further includes means for rotating said take-up reel at a speed greater than the driving speed of the web, and said projections being disposed relative to each other so that the rotational movement of the take-up reel positions the web on the inclined surfaces of the projections upon engagement of the web by said engaging surfaces and exerts forces through said web on the inclined surfaces of the projections due to speed of the reel thereby increasing the grip of the web therebetween.

9. The take-up device of claim 6 in which one of said flange surfaces is slidably mounted on the hub portion to vary the width of the web supported on the hub portion.

10. A self-threading take-up device comprising:

a. a take-up reel having a hub portion and two radially-extending flange members spaced apart a distance to accommodate a web of material which is wound onto the reel;

b. a plurality of projections disposed on the inside face of each of said flange members away from said hub portion, each of said projections being oppositely aligned on said flange members and having a web-supporting surface inclined inwardly towards said hub portion and a web-engaging surface located adjacent the end of the supporting surface and extending in a direction parallel with the surface of the hub portion;

c. means for rotating said reel at a predetermined speed;

d. and means for driving a web at a speed less than the rotational speed of said reel and into engagement with the inclined surfaces of said projections whereby the leading portion of the web will move along the inclined surfaces of a first pair of said oppositely-aligned projections to a position adjacent said hub portion and into engagement with the engaging surfaces of said first pair of projections to initiate the winding of the web onto the inclined surfaces of succeeding projections upon further rotation of the reel.

11. The take-up device of claim 10 wherein the projections are triangular in shape and extend in a plane substantially parallel to the hub portion of the reel and in a direction opposite to the rotational movement of the reel.

12. The take-up device of claim 10 wherein a second pair of projections are disposed relative to said first pair of projections so that the rotational movement of the take-up reel positions the web on the inclined surfaces of said second pair of projections upon engagement of the web by the engaging surfaces of said first pair of projections and exerts forces through said web on the inclined surfaces of said second pair of projections thereby increasing the grip of the web therebetween.

13. The take-up device of claim 12 in which one of said flanges is slidably mounted on the hub portion to vary the width of the web supported on the hub portion.

14. The take-up device of claim 11 in which the inclined surfaces of said oppositely-aligned projections extends inwardly a distance to provide a width which is less than the width of the web, whereby rotation of the reel will wind the web on the inclined surfaces of the projections.

* * * * *